US005129277A

United States Patent [19]

Lautzenhiser

[11] Patent Number: 5,129,277

[45] Date of Patent: Jul. 14, 1992

[54] X-Y CONTROLLER WITH PIVOTALLY MOUNTED TRANSDUCERS

[76] Inventor: John L. Lautzenhiser, 2542 Todd La., Windsor, Ontario, Canada, M9H 1K5

[21] Appl. No.: 590,876

[22] Filed: Oct. 1, 1990

[51] Int. Cl.[5] ..... G05G 9/00; G05G 13/00

[52] U.S. Cl. ..... 74/471 XY; 338/128

[58] Field of Search ..... 74/104, 471 XY, 525, 74/526; 200/6 A; 251/285, 288; 338/128; 273/148 B

[56] References Cited

U.S. PATENT DOCUMENTS

| | | | |
|---|---|---|---|
| 2,700,904 | 2/1955 | Woods | 74/104 X |
| 3,286,545 | 11/1966 | Malachowski | 74/526 X |
| 3,550,466 | 12/1970 | Ham | 74/471 XY |
| 3,711,811 | 1/1973 | Oka et al. | 338/128 |
| 3,807,254 | 4/1974 | Brakebill | 74/526 |
| 3,942,148 | 3/1976 | Nishioka | 74/471 XY X |
| 4,572,477 | 2/1986 | Phlipot et al. | 251/285 |
| 4,587,510 | 5/1986 | Kim | 74/471 XY X |

*Primary Examiner*—Allan D. Herrmann
*Assistant Examiner*—David W. Laub
*Attorney, Agent, or Firm*—Wendell E. Miller

[57] ABSTRACT

An X-Y controller (10) includes a first part (12) that is spherically guided by a second part (20). First and second shafts (26) of first and second transducers (24) are secured to the spherically guided first part (12). First and second levers (54) are mounted to first and second bodies (28) of the first and second transducers (24). The levers (54) each include a slot (58) which engages a respective one of first and second pins (60) that are inserted into the second part (20). In response to a first one of the mechanical inputs (X or Y), both of the shafts (26) of the transducers (24) are rotationally positioned proportional to the first mechanical input. In response to the second one of the mechanical inputs (Y or X), both of the potentiometers (24) are rotationally positioned about the other axis (Y or X); and the levers (54) and the pins (60) cooperate to rotationally position the bodies of both transducers (24) proportional to the second mechanical input (Y or X). Optionally, by locating the pins (60) at various distances (76, 78, or 80) from the transducers (24), proportionality is changed with respect to one of the mechanical inputs (X or Y).

62 Claims, 5 Drawing Sheets

X-Y CONTROLLER WITH PIVOTALLY MOUNTED TRANSDUCERS

BACKGROUND OF THE INVENTION

1. Field of the Invention

The present invention relates generally to controllers in which X and Y outputs are produced proportional to X and Y inputs. More particularly the present invention relates to X-Y controllers in which electrical outputs, proportional to X and Y mechanical inputs, are produced, and in which proportionalities are selectively changeable.

2. Description of the Related Art

X-Y controller are used for a variety of purposes, ranging from use with video games to controlling movements of heavy pieces of industrial equipment. In all of these applications, mechanical inputs with respect to X and Y axes are converted into electrical resistances by rotating shafts of first and second potentiometers.

For applications involving the safety of personnel and the safety of expensive equipment, high degrees of reliability and durability are required. In addition, the X-Y controller should be able to withstand rough handling and impacts from foreign objects. For instance, when used for controlling left and right motors of electrically propelled wheelchairs, the controller should be able to withstand the impact of the control handle being driven under a table with no more damage than bending the control handle. However, in prior art designs, such an impact has completely destroyed the X-Y controller.

Typically, in X-Y controllers of prior art configurations, a control handle has been mounted for pivotal movement about the intersection of X and Y axes. First and second rotary potentiometers have been mounted along respective ones of the X and Y axes; and some mechanical mechanism, such as slotted yokes, has been used to translate X and Y movement of the control handle into rotary movement for respective ones of the transducers.

Variations in this typical type of X-Y controller are taught by Hayes, U.S. Pat. No. 4,489,034, issued Dec. 18, 1984; Kim, U.S. Pat. No. 4,587,510, issued May 6, 1986; and Hayes, U.S. Pat. No. 4,620,176, issued Oct. 28, 1986.

When these prior-art type of controllers are used to control a pair of electric propulsion motors, the X-Y controller is rotated 45 degrees about a Z axis. Movement of the control handle away from the operator, that is, in a forward direction between the X and Y axes, provides outputs from both potentiometers that are equal and that are proportional to movement from the intersection of the X and Y axes.

In like manner, movement of the control handle toward the operator, that is, in the reverse direction, provides outputs from both of the potentiometers that are equal, that are proportional to movement from the intersection of the X and Y axes, and that are in the same direction, but that are in the opposite direction from the outputs produced when the control handle is moved in a forward direction.

When the control handle is moved to the right or to the left, the outputs from the potentiometers, while remaining proportional to input of the control handle from the intersection of the X and Y axes, are opposite in direction.

In movements of the control handle forward from the intersection of the X and Y axes, in movements of the control handle rearward, and in movements of the control handle to the left or to the right, the proportionally of output to input is the same.

Thus, when this prior art device is used to control a conveyance such as an electrically-propelled wheelchair, this prior art controller provides the same magnitude of electrical output vs input for reverse propulsion as for forward propulsion. Obviously, this is not desirable, since, for safety, the maximum speed in reverse should be lower than the maximum forward speed.

This equality in proportionality of electrical output to mechanical input is a more serious drawback of this type of X-Y controller when turns are considered.

Typically, an electrically-propelled wheelchair is steered by changing the speed of left and right propulsion motors, as taught in Lautzenhiser et al., U.S. Pat. No. 4,906,906, issued Mar. 6, 1990.

This method of steering provides the capability of making pivot turns. That is, when one wheel rotates in one direction, and the other wheel rotates in the opposite direction at the same velocity, the wheelchair pivots about a substantially stationary axis that intercepts the wheelchair.

However, the ability to make pivot turns, without some method of limiting this maneuver as a function of speed, can make an electrically propelled conveyance extremely dangerous to the operator.

Of additional concern is the fact that, with this prior art type of X-Y controller, the maximum output of the potentiometers doe snot occur when the control handle is moved in the forward direction, nor in the reverse direction, nor at right angles to these directions. Instead, maximum outputs of the potentiometers occur at 45 degrees to any of these directions.

Therefore, when making a turn in which the control handle is moved form an extreme forward position to a position between the extreme forward position and an extreme rightward position, the forward output signal from the left-motor potentiometer is increased by approximately forty-one percent. Unless the wheelchair has already been operating a maximum power, such a maneuver increases the power to the left-wheel motor, causing an overspeeding of the left-wheel motor, and causing a dangerously fast turn.

That is, for a safe turn, the motor rotating the wheel on the outside of a turn should rotate more slowly, in addition to the motor for the inside wheel rotating more slowly. Instead, the prior art controller inherently increases the output signal that controls the outside motor.

This increase in output signal is an inherent function of the fact that the X-Y controller has been rotated 45 degrees about the Z axis to make it more or less suitable for controlling electrically-propelled wheelchairs.

Because of this rotation of 45 degrees about the Z axis, the output from both of the potentiometers, in forward, rearward, right turn, or left turn positions, is equal to their maximum outputs multiplied by the sine of 45 degrees. That is, they produce about 70 percent of the maximum output when the control handle is moved to these positions.

However, since the X-Y controller has been rotated, with respect to the operator, 45 degrees around a Z axis, when the control handle is moved in a direction that is 45 degrees away from directly forward, directly rearward, or directly o one side, it si moved at 0, 90, 180, or 270 degrees with respect to the X-Y controller.

Thus, when the control handle is moved in a direction that is 45 degrees away from forward, one of the potentiometers produces a maximum output and the other potentiometer does not produce any output. This causes the outside wheel of an electrically-propelled wheelchair to overspeed when making turns.

In an attempt to obviate this overpower condition that occurs during turns, a horizontally-disposed plate with a diamond-shaped opening has been used in some prior art designs to prevent movement of the control handle into the areas in which overspeeding occurs during turns.

However, limiting movement of the control handle to this diamond-shaped area has the disadvantage of limiting maximum forward speed to an apex formed by this diamond-shaped path. Therefore, as the conveyance tends to drift to the left or to the right, as caused by slightly unequal loads of the left and right propulsion motors, it has been impossible to move the control handle to the left or to the right to compensate for this drift, without also moving the control handle rearward toward a lower forward speed.

In an attempt to eliminate this drift to one side, and thereby to overcome the control-handle limitations imposed upon the X-Y controller by a diamond-shaped opening, at least one manufacturer has resorted to synchronizing the rotational velocities of the two propulsion wheels. In addition to the original cost and complexity of such an arrangement, maintenance cost have also increased.

In a prior art X-Y controller of common inventorship entity to the present invention, a differential-gear arrangement was used to provide outputs from two potentiometers proportional to input.

In this prior art X-Y controller, the bodies of two potentiometers were mounted onto a framework with the shafts of the potentiometers coaxial and facing each other, and with a bevel gear mounted onto the shaft of each potentiometer. A cage was pivotally mounted onto the potentiometer shafts so that the age could pivot freely about one axis; and a gear shaft was mounted to the cage at right angles to the potentiometer shafts and the two bevel gears. Third and fourth gears where mounted to the gear shaft, and meshed with the first and second gears on opposite side thereof. A control handle was connected to the fourth gear.

When the control handle was moved along one axis, the fourth gear was rotated about the gear shaft, thereby rotating the third and fourth gears in opposite directions, and thereby rotating the first and second gears, together with the potentiometer shafts, in opposite directions.

When the control handle was moved along the other axis, the third and fourth gears along with the cage were rotationally positioned about the other axis, thereby rotating both of the shafts of the potentiometers in the same direction while the gears remained in fixed rotational positions.

The X-Y controller of common inventorship entity and the present invention includes some interesting similarities and differences: Both inventions dispose the transducers coaxially with the shafts thereof proximal to one another, rather than being disposed at 90 degrees, one to the other. However, in this prior design, the transducers are fixedly secured to a base, whereas in the present invention the transducers are pivotally mounted and are pivoted around one axis. Also, in the prior invention, the transducers were connected to the mechanical input by four gears, whereas in the present invention, the shafts are connected directly into the mechanical input device. Further, in the prior design, both X and Y inputs rotate the transducer shafts, whereas in the present invention, an input around the X axis rotates the transducer shafts, and an input around the Y axis rotates the transducer bodies.

However, in spite of these vastly different constructions, the operation is identical in three respects. First: in response to an input around the Y axis, both transducers of both inventions are actuated together, even though, in the prior invention, this function was the result of four gears acting as a differential gear. Second: both transducers produce outputs when a mechanical input is parallel or orthogonal to a transducer axis, whereas in traditional designs, both transducers do not produce outputs, except for mechanical inputs that are not aligned with one of the transducers. Third: the relative rotation of transducer shafts to transducer bodies are in the same direction in response to one, X or Y, input, and are in opposite directions in response to the other input, Y or X.

These similarities are interesting. However, it is evident that it would not be possible to start with these functions of the prior invention and arrive at an invention, such as the present invention, that is so dissimilar in construction.

While this X-Y controller of common inventorship entity was unique, it did not overcome the problem of incurring greater outputs at directions intermediate of the basic forward, reverse, and pivot-turn positions. Also, it had some other limitations which the present invention overcomes. Namely, since the cage was mounted onto the potentiometer shafts, the design had mechanical-strength limitations in that the potentiometers were subject to damage from excessive loads placed onto the control handle. Also, since the control handle also placed loads on the meshing gears, the design had mechanical-strength limitations.

In contrast to the prior art designs, the present invention is extremely resistant to excessive control handle loading, provides different proportionalities between movement along X and Y axes, thereby providing safe and gentle turns when used to control electric wheelchairs, allows changing the proportionality of input to output with respect to movement of the control handle along one axis to compensate for limitations in motor skill of the operator, and allows changing the proportionality with respect to one transducer without changing the proportionality with respect to the other transducer, thereby further allowing compensation for limitations of motor skill of the operator.

SUMMARY OF THE INVENTION

In the present invention, an X-Y controller is provided which includes a first part having a spherical surface, a cage having a cooperating contour that guides the first part in pivotal movement around the intersection of X and Y axes, the first and second shafts of first and second rotary transducers being secured to the first part with the shafts disposed on the X axis and with the shafts being on the same axis and facing each other, first and second levers being attached to bodies of respective ones of the transducers, and first an second pins being inserted into first and second holes in the cage and engaging first and second slots in respective ones of the first and second levers.

When a mechanical input about the X axis is applied to the first part, the shafts of both transducers, being disposed one the X axis, are rotationally positioned about the X axis.

When a mechanical input about the Y axis is applied to the first part, both the transducers, both bodies and shafts, are pivoted, or rotationally positioned, about the Y axis. This positioning of the transducers around the Y axis rotationally positions the transducer bodies with respect to the pins that engage respective ones of the levers.

Thus, as the transducers are positioned with respect to the pins, the transducer bodies are rotationally positioned by levers and pins; so that the transducer bodies are rotationally positioned with respect to their shafts.

The invention described thus far provides X and Y outputs that are proportional to X and Y mechanical inputs. That is, a mechanical input rotates the first part about one axis for a given number of degrees. In response, the shaft, or the body, of one transducer is rotated by an angle that is proportional to the angle of the mechanical input, and the transducer produces a non-mechanical output that is a function of the angle of rotation of its shaft or body. Therefore, there is a mechanical proportionality between the mechanical input and the rotation of either the shaft or the body of a transducer, there is a proportionality between the rotation of the shaft or body of the transducer and the non-electrical output, and there is an overall proportionality between the mechanical input and a non-mechanical output. This proportionality can be changed with respect to the Y axis by selectively positioning one or both of the pins in alternate holes that are provided in the cage.

Changing the pins to holes which are nearer the bodies of the transducers effectively decreases the length of the levers, thereby thereby increasing the non-mechanical output versus mechanical input; whereas changing the pins to holes which are farther from the transducers effectively increases the length of the levers, thereby thereby decreasing the non-mechanical output versus mechanical input.

Therefore, the proportionality of mechanical input to electrical output can be changed with respect to movement of the control handle along one axis while maintaining a different proportionality of mechanical input to electrical output with respect to movement of the control handle along the other axis.

Further, since the effective length of the levers can be changed individually by locating the pins in holes closer or farther from the transducers, the proportionalities of input to output can be changed with regard to one transducer while maintaining another proportionality with regard to the other transducer.

The present invention provides excellent reliability and high resistance to damage. The first part and the cage provide rotational pivoting about the X and Y axes that can withstand heavy loads or impacts from the handle along X, Y, and Z axes and in directions that are at any combination of these axes. Further, movement of the control handle in X and Y directions, or any combination of these directions, is resisted by the shaft of the handle striking the cage. By making the cage of high strength material, such as a surface-hardened aluminum, a force or impact that will bend a 0.250 diameter stainless steel shaft doe snot do any internal damage. Thus, repairing the X-Y controller to original quality is achieved by merely replacing the handle shaft. This can be done without diassembling the X-Y controller.

In a first aspect of the present invention, a controller is provided which comprises a mechanical input device; attaching means, being operatively attached to the mechanical input device, for allowing selective positioning of the mechanical input device with respect to orthogonally-disposed first and second axes; first and second transducers; means, including the mechanical input device being operatively connected to the first transducer, for producing an output from the first transducer that is proportional to selective positioning of the mechanical input device along the first axis; means, including the second transducer being operatively connected to the attaching means, for producing an output from the second transducer that is proportional to selective positioning of the mechanical input device along the second axial; and means for selectively changing the proportionality with respect to selective positioning of the mechanical input device along one of the axes.

In a second aspect of the present invention, a controller is provided which comprises a first part; means, including a second part, for allowing the first part to pivot around orthogonally-intersecting first and second axes; first and second transducers each having first and second relatively rotatable portions; means, including attaching one of the portions of the first and second transducers to the first part, for pivoting both of the transducers around one of the axes in accordance with selective positioning of the first part about the one axis; and means, including first and second mechanical connections between the second part and respective ones of the other of the portions of the transducers, for positioning the second portions of the transducers proportional to the selective positioning of the first part around the one axis.

In a third aspect of the present invention, a method is provided for producing non-mechanical outputs that are proportional to X and Y mechanical inputs, which method comprises providing a mechanical input with respect to orthogonally-disposed axes; developing a first non-mechanical output that is proportional to the mechanical input with respect to one of the axes; developing a second non-mechanical output that is proportional to the mechanical input with respect to the other of the axes; and selectively changing the proportionality with respect to one of the axes.

In a fourth aspect of the present invention, a method is provided which comprises guiding a first part for positioning around the intersection of X and Y axes; mounting first portions of first and second transducers onto the first part for pivoting the transducers about one of the axes; and providing mechanical inputs to second portions of both of the transducers proportional to one mechanical input with respect to the one of the axes.

In a fifth aspect of the present invention, a controller is provided for providing outputs that are proportional to mechanical inputs with respect to orthogonally-disposed first and second axes, which controller comprises first and second transducers each having first and second portions that are relatively rotationally positionable; means, being operatively connected to one of the portions of both of the transducers, for rotationally positioning the one portion of both of the transducers proportional to a mechanical input along one of the axes; and means, being operatively connected to the other of the portions of both of the transducers, for rotationally positioning the other portion of both of the transducers proportional to a mechanical input along the other of the axes.

In a sixth aspect of the present invention, a method is provided for producing proportional outputs from first and second rotary transducers, that axes, which method comprises rotationally positioning one portion of both of the transducers proportional to one of the mechanical inputs; and rotationally positioning the other portion of both of the transducers proportional to the other of the mechanical inputs.

In a seventh aspect of the present invention, a controller is provided which comprises a mechanical input device; first and second transducers each having a body, and each having a rotary shaft that is rotationally positionable about a transducer axis; and means, including means for mechanically coupling the shafts coaxially with the bodies distal from one another, and including means for mechanically connecting the mechanical input device to the transducers, for producing outputs from the transducers that are proportional to displacement of the mechanical input device around the transducer axis; and means for producing outputs from both of the transducers in response to movement of the mechanical input device about an axis that is orthogonal to the transducer axis.

In an eighth aspect of the present invention, a method is provided for producing proportional outputs from first and second transducers, each having a body and each having a rotary shaft that is rotatable around a transducer axis, which method comprises rotationally securing the shafts, whereby the shafts rotate as a single shaft; using a first mechanical input to rotate both of the shafts; and using a second mechanical input, that is disposed orthogonally to the first input, for producing outputs from both of the transducers.

In a ninth aspect of the present invention, a controller is provided which comprises means, including first and second transducers, and including a mechanical input device that is operatively connected to the transducers, for producing outputs from he transducers that are proportional to displacement of the mechanical input device from the intersection of orthogonally-disposed axes; means for limiting movement of the mechanical input device to a substantially circular path about the intersection of the axes; and means for mechanically changing the proportionality with respect to one of the axes.

In a tenth aspect of the present invention, a method is provided for producing outputs from first and second transducers proportional to displacement of a mechanical input device from the intersection of orthogonally-disposed axes, which method comprises limiting movement of the mechanical input device to a substantially circular path about the intersection of the axes; and mechanically changing the proportionality with respect to one of the axes.

In an eleventh aspect of the present invention, a controller is provided which comprises first and second transducers, a mechanical input device being operatively connected to both of the transducers; means, including the operative connection of the mechanical input device to the transducers, for producing outputs from the transducers that are proportional to displacement of the mechanical input device from the intersection of first and second axes; and means for selectively changing the proportionality of one of the transducers from a first proportionality to a second proportionality with respect to movement of the mechanical input device along one of the axes without changing the proportionality of the other of the transducers.

In a twelfth aspect of the present invention, a method is provided which comprises producing outputs from first and second transducers that are proportional to displacement of a mechanical input device from the intersection of X and Y axes; and selectively changing the proportionality of one of the transducers from a first proportionality to a second proportionality with respect to movement of the mechanical input device along the one axis without changing the proportionality of the other of the transducers.

In a thirteenth aspect of the present invention, a controller is provided which comprises a mechanical input device; guiding means, being operatively attached to the mechanical input device, for allowing selective positioning of the mechanical input device with respect to orthogonally-disposed first and second axes; first and second transducers each having first and second portions that are relatively rotational around respective ones of transducers axes; means, including disposing the transducer axes coaxially, rotationally securing one of the portions of one of the transducers to one of the portions of the other of the transducers, and operatively connecting both of the transducers to the mechanical input device, for producing outputs from both of the transducers that are proportional to selective positioning of the mechanical input device along one of the axes; and means, including means for operatively connecting the transducers to the guiding means, for producing outputs from both of the transducers that are proportional to selective positioning of the mechanical input device along the other of the axes.

In a fourteenth aspect of the present invention, a method is provided for producing X and Y proportional outputs from first and second rotary transducers, having first and second portions that are rotatable around respective transducers axes, in response to orthogonally-disposed X and Y mechanical inputs, which method comprises disposing the transducer axes coaxially; and rotationally securing one of the portions of one of the transducers to one of the portions of the other of the transducers.

DESCRIPTION OF THE PREFERRED EMBODIMENTS

Figure 1:
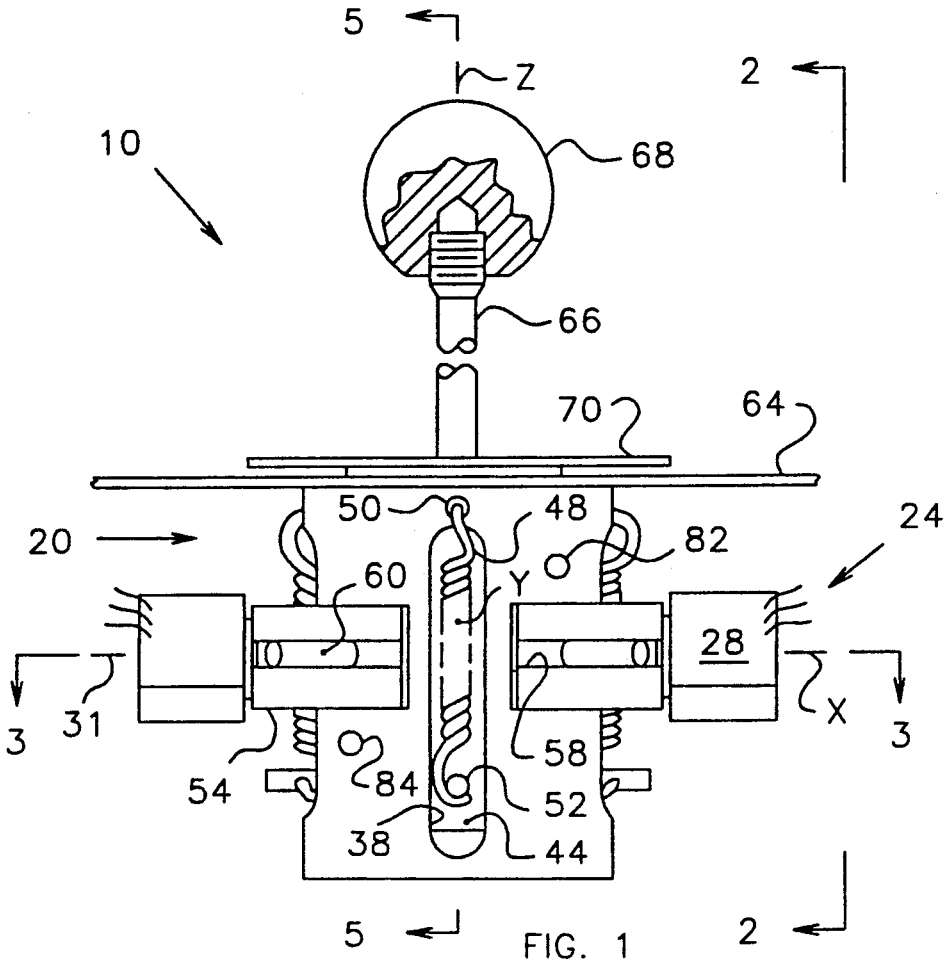
FIG. 1 is a front elevational of an X-Y controller made in accordance with the teaching of the present invention.

Referring now to FIGS. 1-5, an X-Y controller 10 includes a first part 12 having a spherical contour 14 and a first surface 16. The first part 12 is inserted into a cylindrical bore 18 of a second part, or cage, 20. The first part 12 is guided for spherical movement around the intersection of X, Y, and Z axes by the spherical contour 14 of the first part 12 engaging a step, or shoulder, 22 of the second part 20.

The X-Y controller 10 includes first and second rotary transducers, or rotary potentiometers, 24 each having a first relatively rotatable portion, or rotary shaft, 26, and each having a second relatively rotatable portion, or body, 28.

The shafts 26 are inserted into respective ones of holes 30 in the first part 12; with first and second transducer axes 31 of the shafts 26 coaxial so that both of the shafts 26 are rotationally positioned when the first part 12 is rotationally positioned about the X axis of a pivot axis 32 at the intersection of the X, Y, and Z axes; and so that both of the transducers 24, including both shaft 26 and body 28, are rotationally positioned about the Y axis of the pivot axis 32 when the first part is rotationally positioned about the Y axis.

The shafts 26 extend inwardly through respective ones of slots 34 that are longitudinally disposed in the second part 20. The slots 34 allow the shafts 26 to move vertically as the first part 12 is rotated in an X direction about the Y axis.

The second part 20 also includes slots, 36 and 38, which are longitudinally disposed. A pin 40, which is installed in a hole 42 of the first part 12, slidably engages the slot 36 thereby allowing the first part 12 to rotate about the X axis as the pin 40 moves vertically in the slot 36. Engagement of the pin 40 with the slot 36, while allowing rotational positioning about the X axis, prevents rotational movement about the Z axis.

A third part 44 that is generally cylindrical in shape includes a second surface, or cooperating surface, 46. The third part 44 is inserted into the cylindrical bore 18 of the second part 20, and the second surface 46 of the third part 44 is resiliently urged into contact with the first surface 16 of the first part 12 by three springs 48. The springs 48 are attached to the second part 20 by respective ones of three holes 50 and by respective ones of three pins 52 that are inserted into the third part 44.

Therefore, the springs 48 cooperate with the first surface 16 of the first part 12 and the second surface 46 of the third part 44 to resiliently urge the first part 12 to a neutral position with respect to the X and Y axes.

First and second levers 54 are secured to the second portions 28 of respective ones of the rotary transducers 24 by respective ones of transducer nuts 56. First and second slots 58 are disposed in the first and second levers 54 distal from the attachment of the first and second levers 54 to the rotary transducers 24. The first and second slots 58 are engaged by first and second pins 60 that are disposed in first and second pin holes 62 in the second part 20.

Figure 4:
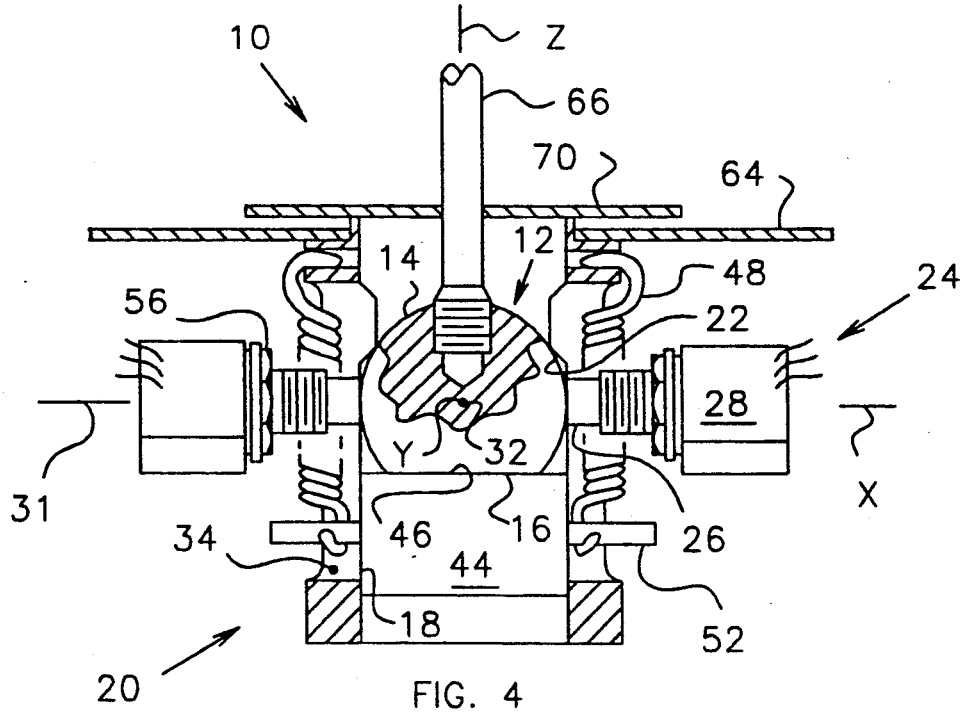
FIG. 4 is a cross sectional elevation taken substantially the same as FIG. 1, and also taken substantially as shown by section line 4—4 of FIG. 2.

The X-Y controller 10 also includes a top plate 64 that is securely attached to the second part 20 by any suitable means, a handle rod 66 that preferably is screwed into the first part 12 as shown in FIG. 4, a control handle, or mechanical input device, 68 that preferably is screwed onto the rod 66 as shown in FIG. 1, and a floating cover plate 70 that slidably receives the handle rod 66, and that is positioned with respect to the X and Y axes by the handle rod 66. The cover plate 70 provides a cover over the cylindrical bore 18, thereby excluding foreign matter from the cylindrical bore 18 and the first part 12.

Finally, the second part 20 includes two pin holes 72 that are closer to respective ones of the rotary transducers 24 than are the pin holes 62, and the second part 20 includes two pin holes 74 that are farther from respective ones of the rotary transducers 24 than are the pin holes 62.

Figure 2:
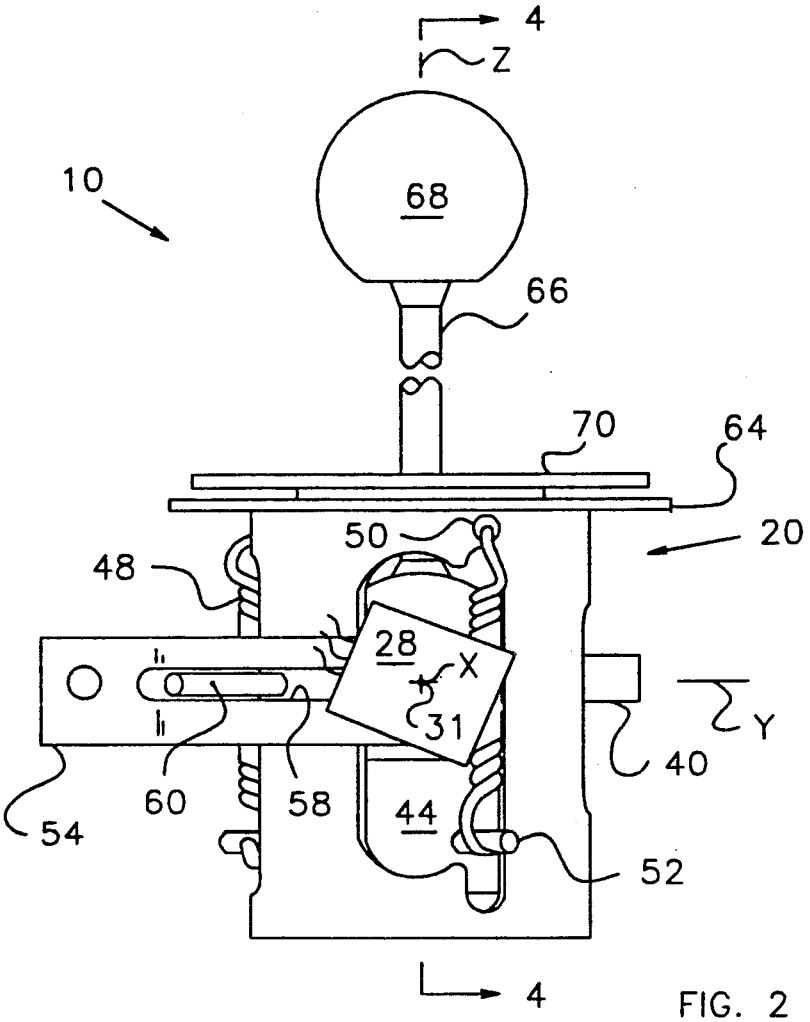
FIG. 2 is a side elevation of the X-Y controller of FIG. 1, taken substantially as shown by view line 2—2 of FIG. 1.
Figure 5:
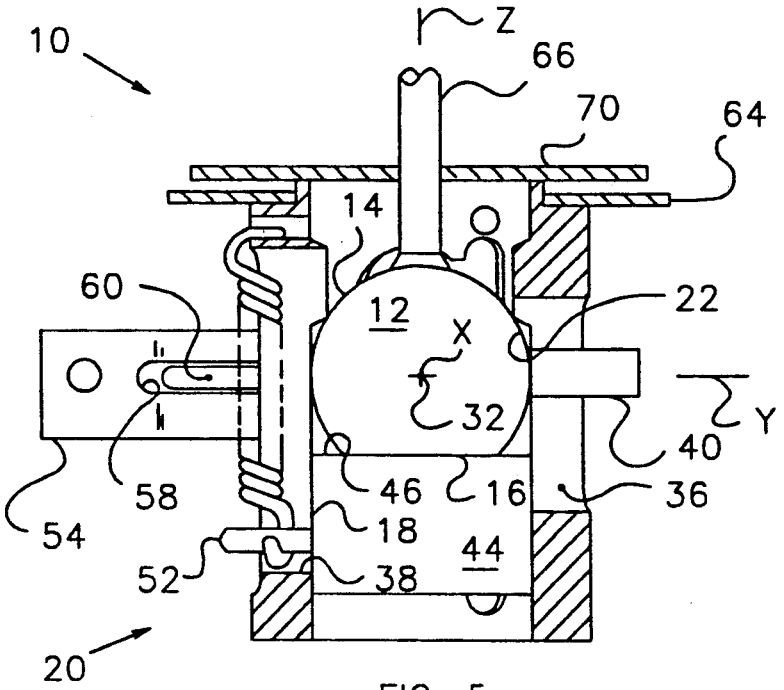
FIG. 5 is a cross sectional elevation taken substantially the same as FIG. 2, and also taken substantially as shown by section line 5—5 of FIG. 1.
Figure 8:
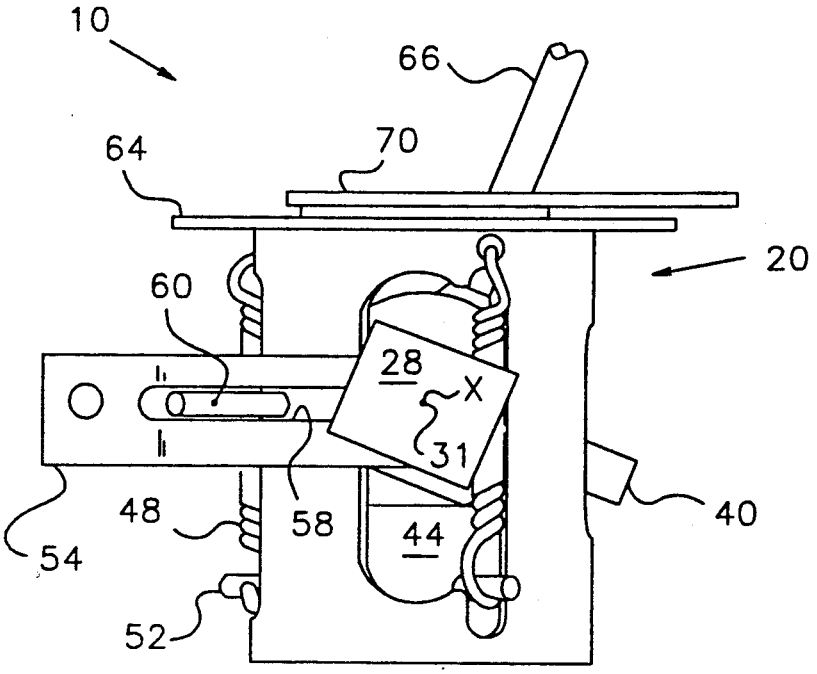
FIG. 8 is a side elevation of the embodiment of FIG. 1, taken substantially the same as FIG. 2, but with the control handle thereof moved to a Y input position.
Figure 9:
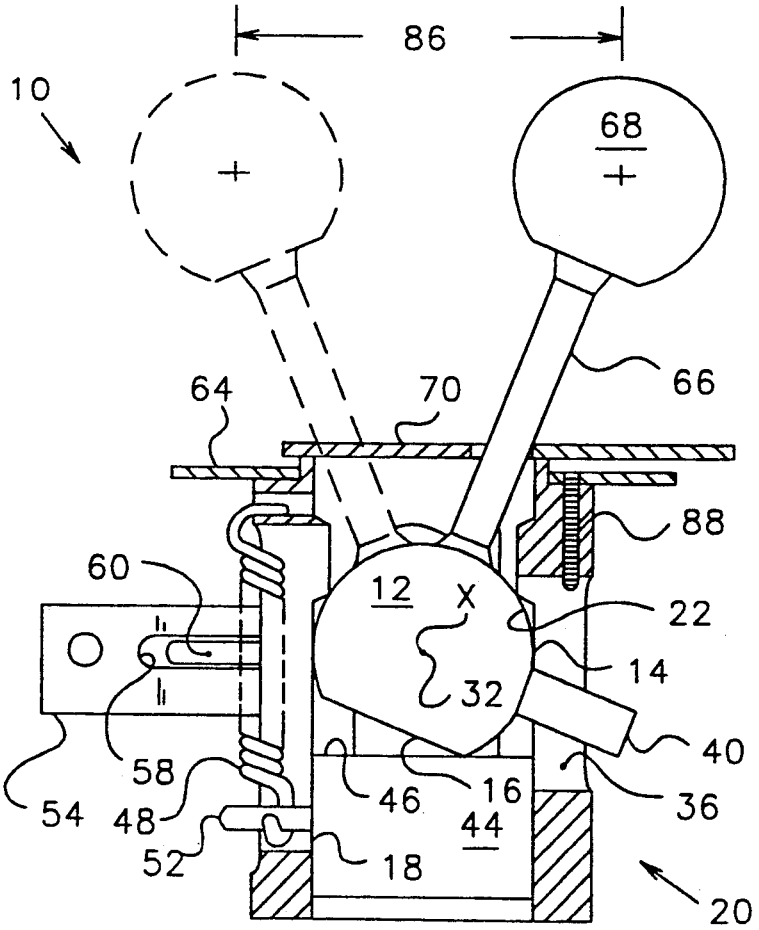
FIG. 9 is a cross sectional elevation taken substantially the same as FIG. 8, and with the control handle thereof moved to the Y input position of FIG. 8.

Referring now to FIGS. 2, 8, and 9, in operation, movement of the handle 68 in the Y direction as shown in FIGS. 8 and 9 rotates both of the shafts 26 of respective ones of the rotary transducers 24, but the levers 54 remain aligned as shown in FIGS. 2 and 8.

Figure 6:
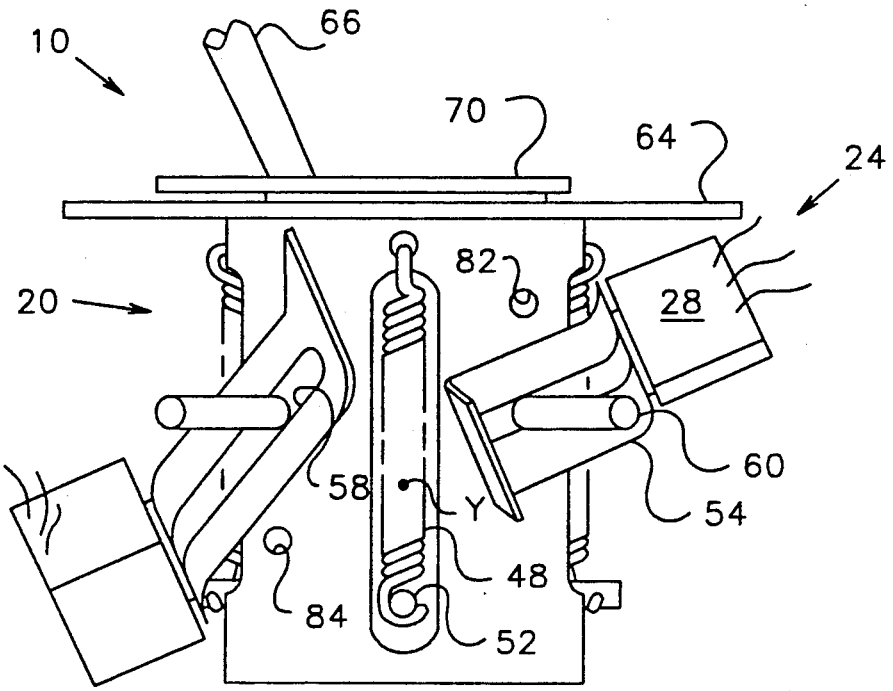
FIG. 6 is a front elevation taken substantially the same as FIG. 1, but with the control handle thereof moved to an X input position.
Figure 7:
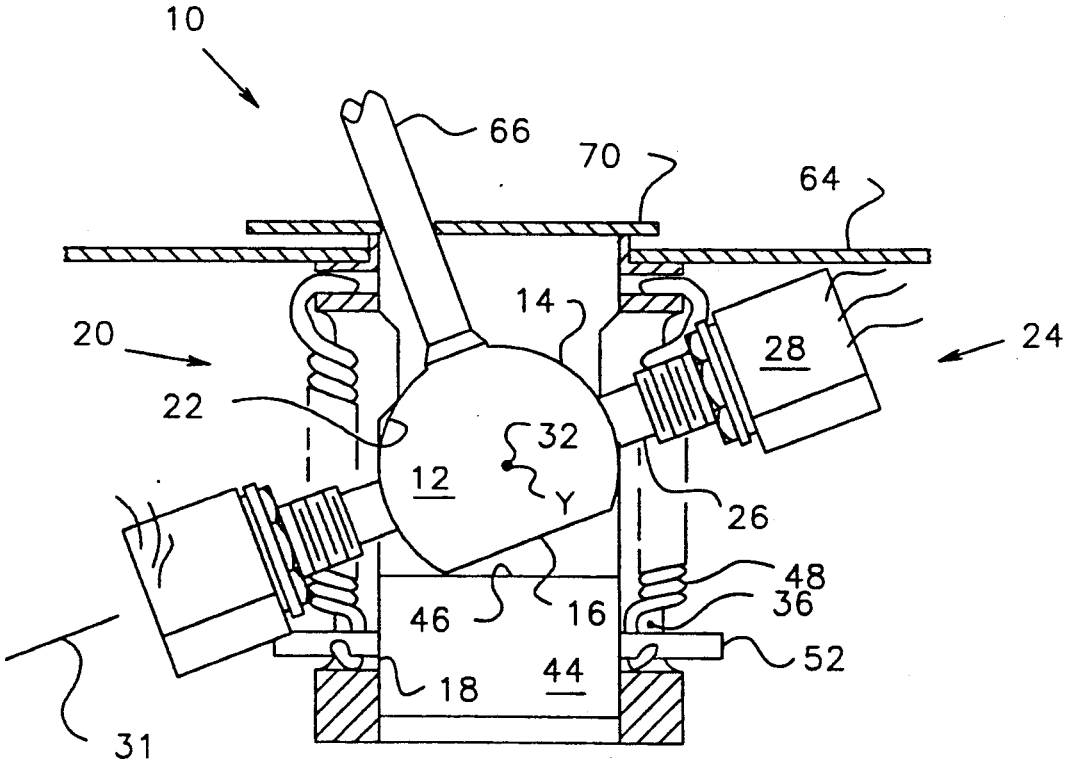
FIG. 7 is a cross sectional elevation taken substantially the same as FIG. 6, and with the control handle thereof moved to the X input position of FIG. 6.

Referring now to FIGS. 1, 6, and 7, when the handle 68 is moved in an X direction as shown by FIGS. 6 and 7, one of the rotary transducers 24 is moved upwardly and the other of the rotary transducers 24 is moved downwardly, as shown in FIGS. 6 and 7. Since respective ones of the pins 60 engage respective ones of the slots 58 of the levers 54, this upward and downward movement of respective ones of the rotary transducers 24 causes rotary positioning of the bodies 28 of the transducers 24.

Therefore, as described above, movement of the handle 68 in the Y direction about the X axis rotationally positions the first part 12 and the shafts 26 of the rotary transducers 24 about the X axis.

Movement of the handle 68 in the X direction about the Y axis rotationally positions the rotary transducers 24, both shaft 26 and body 28, about the Y axis; and this rotational positioning of the rotary transducers 24 about the Y axis cooperates with the levers 54 and the pins 60 to rotate the bodies 28 of the rotary transducers 24 with respect to their shafts 26, and in opposite directions as shown in FIGS. 6 and 7.

Figure 3:
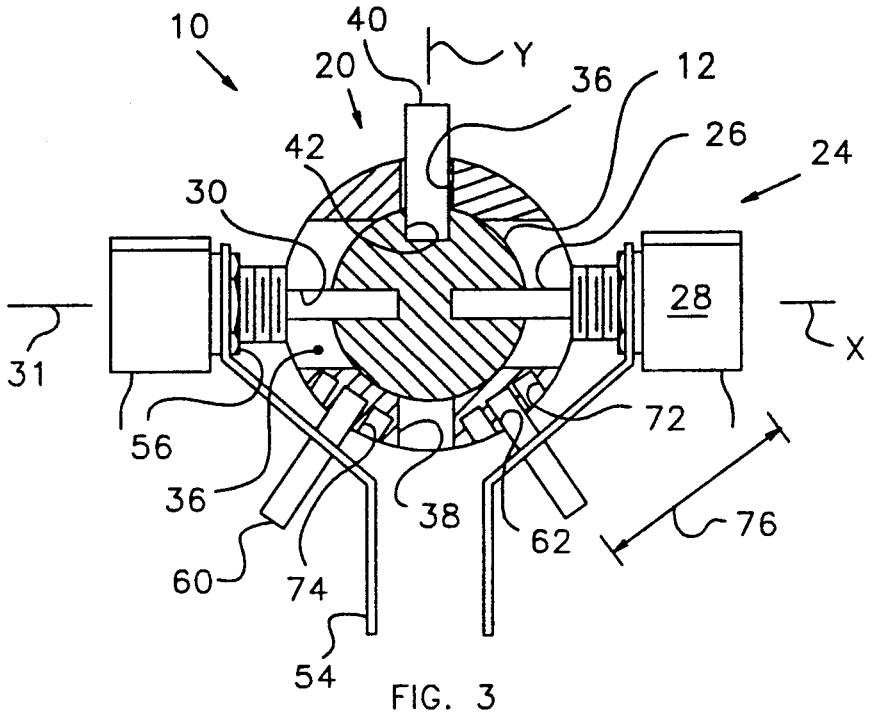
FIG. 3 is a horizontal cross section of the embodiment of FIGS. 1 and 2 taken substantially as shown by section line 3—3 of FIG. 1.
Figure 10:
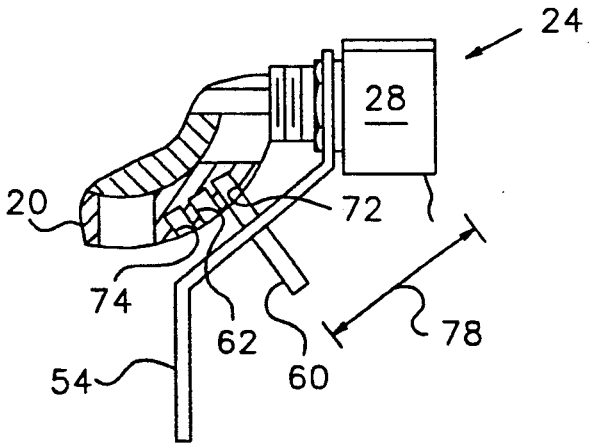
FIG. 10 is a fragmentary cross section, taken substantially the same as FIG. 3, and showing the proportionality of one output changed by moving one pin closer to the transducer.
Figure 11:
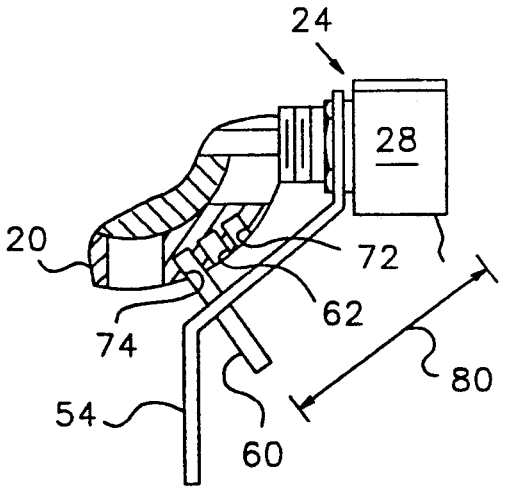
FIG. 11 is a fragmentary cross section, taken substantially the same as FIG. 3, and showing the proportionality of one output changed by moving one pin farther from the transducer.

Referring now to FIGS. 3, 6, and 7, if the pins 60 are removed from the pin holes 62 and inserted in the pin holes 72 which are closer to the rotary transducers 24, then for a given rotation of the first part 12 and the transducers 24 about the Y axis, the bodies 28 of the transducers 24 will be rotated a greater angular distance.

Conversely, if the pins 60 are inserted into the pin holes 74 which are farther from the rotary transducers 24, then for a given rotation of the first part 12 and the transducers 24 about the Y axis, the bodes 28 of the transducers 24 will be rotated a lesser angular distance.

The X-Y controller 10 also includes pin holes 82 and 84. The pin hole 82 is disposed above the pin holes 62, 72, and 74; whereas the pin hole 84 is disposed below the pin holes 62, 72, and 74.

As can be seen by inspection, or as can be calculated by trigonometry, disposing one of the pins 60 in the pin hole 82 which is disposed above the pin hole 62, or disposing one of the pins 60 in the pin hole 84 which is disposed below the pin hole 62, effectively changes the proportionality of input to output for one of the potentiometers 24 with respect to movement of the control handle 68 about one of the axes.

From the preceding description it can be seen that the handle 68 serves as a mechanical input device, and that the present invention provides means for producing outputs from the rotary transducers 24 that are proportional to displacement of the handle 68 with respect to X and Y axes.

Referring now to FIGS. 3, 6, 10, and 11, it can be seen that the pins 60 cooperate with the holes 62, 72, 74, 82, and 84 provide means for selectively changing the proportionality, with respect to rotation of the first part 12 about the Y axis. That is, in FIG. 3, the pin 60 engages the slot 58 at a first effective distance 76 from the rotary transducer 24; in FIG. 10 the pin 60 engages the slot 58 at a second and smaller effective distance 78 from the transducer 24; and in FIG. 11 the pin 60 engages the slot 58 at a third and larger effective distance 80 from the transducer 24.

Therefore, the pins 60 and the holes 62, 72, 74, 80, and 82 provide means for selectively changing the effective lengths of the levers 54, and provide means for selectively changing the proportionality of input to output with respect to one of the axes. That is, for rotation of the control handle, or mechanical input device, 68, a given number of degrees about the Y axis, the angle of rotation of one of the bodies 28 of a transducer 24 depends upon placement of the pin 60 selectively in one of the holes, 62, 72, or 74.

As described above, the present invention provides means for positioning the transducers 24 about X and Y axes in accordance with selective positioning of the first part 12 about the X and Y axes, provides means for providing outputs that are proportional to X and Y inputs, provides means for selectively changing the proportionality with respect to one of the axes, and provides means for changing the proportionality with respect to one transducer without the necessity of changing the proportionality with respect to the other transducer.

By sizing the first surface 16 and/or the second surface 46, the force required to move the control handle 68 can be designed to provide: a constant force irrespective of the distance from eh center, a force that is a function of the distance moved from the intersection of the X and Y axes, increasing force when moved from the center, a decreasing force when moved from the center, or a locking position that is distal from the center, which may be in any position.

Further, by contouring the first surface 16 and/or the second surface 46, different operating forces can be provided with respect to one movement along one axis as opposed to movement with respect to the other axis. Or, by extending the spherical contour 14, and thereby eliminating the first surface 16, the control handle 68 will not have a preferred position. Instead, the control handle 68, will be retained by friction in any selected position.

The force required to actuate the control handle 68 can be changed by merely substituting softer or firmer springs 48. While a single spring, not shown, could be used and centered on the Z axis, the use of three springs 48 is preferred because of the ease of changing the control handle force as a service function. Also, the use of three springs 48 provides better reliability for critical uses, since one or two of the springs 48 will hold the control handle 68 in a centered position even if one or two springs 48 should break.

Since the handle rod 66 and the control handle 68 are easily replaceable by merely unscrewing the handle rod 66, if damaged they can be replaced easily, or if a longer or shorter handle rod 66 is needed, the change can be made easily and rapidly as a service operation.

Further, since the controller 10 is extremely resistant to damage from large forces being applied to the control handle 68, it is practical to use long rod lengths to provide better control for operators having poor motor skills; even through those with poor motor skills are likely to place unduly large forces on the control handle 68.

The controller of the present invention may be used as a conventional X-Y axis controller by rotating the shafts 26 to a 45 degree position. When installed in this position, the proportionality of input to output, with respect to one of the axes, can be varied simultaneously or independently from the proportionality with respect to the other axis.

When used to control a dual drive, such as used to propel an electric wheelchair, the rate of change of either motor can be changed simultaneously or independently of the other. This can greatly assist a handicapped person who may overcontrol or undercontrol in one direction or the other.

Further, when used to control an electric wheelchair that is capable of relatively high speeds, the pins 60 may be positioned to limit the forward and reverse power in pivotal turns, thereby reducing the maximum rate of turning. Also, this positioning of the pins 60 reduces the speed of the outside wheel when making turns, thereby reducing the risk of upset.

Preferably, the pin hole 72 provides 100 percent power, the pin hole 62 provides 72 percent power, and the pin hole 74 provides 40 percent power.

When the pins 60 are placed into holes, 82 or 84, that are either higher or lower than the pin holes 62, the quadrants are distorted. That is, the area of movement of the control handle 68 for forward propulsion will be different than the area of movement for reverse movement. This can help handicapped people who have trouble in over controlling.

Further, with one of the pins 60 set in pin holes, 72, 74, 82, or 84 of different heights, and/or different distances form the transducers 24, the quadrants can be distorted asymmetrically with respect o the Y axis, and/or the proportionalities with respect to movement about the X axis can be separately changed for the two transducers 24.

As can be seen by inspection of the drawings, the cylindrical bore 18 of the cage 20 cooperates with the handle rod 66 to limit positioning of the control handle 68 to a circular path 86. Therefore, there are no preferred positions which limit the ability to change the speed of one motor, as is the case with prior art designs in which a plate with a diamond-shaped opening prevents movement in the X direction when the control handle is moved to either maximum Y position.

Preferably, the X-Y controller 10 includes an adjusting screw 88, as shown in FIG. 9, which cooperates with the pin 40 to limit the output of the controller 10 in the direction which provides power to reverse an electric wheelchair. That is, the adjusting screw 88 limits movement of the control handle 68 in the direction opposite to that which is shown, in which the pin 40 engages the adjusting screw 88.

The method of the present invention includes the steps of providing outputs that are proportional to mechanical inputs about X and Y axes; and selectively changing the proportionality with respect to one of the axes.

Or, the method of the present invention includes guiding a first part 12 for spherical positioning about the intersection of X, Y, and Z axes; mounting first and second rotary transducers 24 onto the first part 12; and providing mechanical inputs to the transducers 24 that are proportional to spherical positioning of the first part 12 about the X and Y axes.

The X-Y controller 10 of the present invention comprises first and second transducers 24, each having first 26 and second 28 portions that are relatively rotationally positionable; means for rotationally positioning one of the portions, 26 or 28, of both of the transducers 24 proportional to a mechanical input with respect to one of the axes (X or Y); and means for rotationally positioning the other of the portions, 28 or 26, of both of the transducers 24 proportional to a mechanical input with respect to the other of the axes (Y or X).

Or, the X-Y controller of the present invention comprises first and second transducers 24, each having first 26 and second 28 portions that are relatively rotationally positionable; means for spherically positioning the first and second transducers 24 proportional to mechanical positioning of an input device 68 with respect to X and Y axes; means for rotationally positioning one of the portions, 26 or 28, of both of the transducers 24 proportional to positioning around one of the axes (X or Y); and means for rotationally positioning the other of the portions, 28 or 26, of both of the transducers 24 proportional to the positioning about the other of the axes (Y or X).

Further, the present invention includes a method for producing X and Y outputs from rotary transducers 24 that are proportional to mechanical X and Y inputs, which method includes the steps of rotationally positioning one portion, 26 or 28, of both of the transducers 24 proportional to mechanical input with respect to one of the axes (X or Y); and rotationally positioning another portion, 28 or 26, of both of the transducers 24 proportional to mechanical input with respect to the other of the axes (Y or X).

And, the present invention includes a method for producing X and Y outputs from rotary transducers 24 that are proportional to mechanical X and Y inputs, which method includes the steps of rotationally positioning both of the transducers 24 about a Y axis proportional to mechanical X and Y inputs; rotationally positioning one portion, 26 or 28, of both of the transducers 24 proportional to mechanical input with respect to one of the axes (X or Y); and rotationally positioning another portion, 28 or 26, of both of the transducers 24 proportional to mechanical input with respect to the other of the axes (Y or X).

In the present invention, the first and second transducers 24 are disposed along a single transducer axis 31. In contrast, in prior art controllers, the two transducers are disposed at 90 degrees to each other. Further, the present invention and the prior art differ by 45 degrees in the orientation of the transducers to axes of mechanical input. However, in the appended claims, the orientation of the intersecting axes, X and Y, and their relationship to the transducers axes 31 are to be interpreted solely by recitations in respective ones of the claims.

For purposes of understanding the claims, and referring again to FIGS. 1-3, but more particularly to FIG. 3, the X and Y axes are disposed orthogonal to one another and intersect at the pivot axis 32. If the control handle 68 is moved away from this intersection of the X and Y axes, along either of these axes, or at any angle therebetween, then the control handle 68 is moved "with respect to" this intersection of axes. Further, it can be seen by inspection of FIG. 3 that, if the control handle 68 is moved "along" one of the axes, X or Y, then it is moved "around" the other of the axes, Y or X.

Further, while rotary potentiometers have been shown and described, the present invention is equally applicable to other types of transducers, such as mechanical to inductive, and mechanical to optical. Therefore, in the appended claims, transducer should be understood to be any device that receives a mechanical input and that produces an output that is other than mechanical.

While specific apparatus and method have been disclose in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

INDUSTRIAL APPLICABILITY

The present invention is applicable to industrial, military, and consumer equipment in which precise and dependable electrical outputs, proportional to X and Y mechanical inputs, are required. Applications include electrically propelled wheelchairs and other conveyances that are electrically propelled, personal lifting and positioning devices commonly known as cherry pickers, set-up and maintenance controls for various digitally controlled machines, and various other industrial and military equipment.

What is claimed is:

1. A controller (10) which comprises:

a mechanical input device (68);

attaching means (20), being operatively attached to said mechanical input device, for allowing selective positioning of said mechanical input device with respect to orthogonally-disposed first and second (X and Y) axes;

first and second transducers (24);

means (12), comprising said mechanical input device being operatively connected to said first transducer, for producing an output form said first transducer that is proportional to selective positioning of said mechanical input device along said first (Y or X) axis;

means, comprising said second transducer being operatively connected (54, 58, 60, 62) to said attaching means, for producing an output form said second transducer that is proportional to selective positioning of said mechanical input device along said second (X or Y) axis); and means (72, 74, 82 or 84) for selectively changing said proportionality with respect to selective positioning of said mechanical input device along one of said axes.

2. A controller (10) as claimed in claim 1 in which said operative connections of said mechanical input device (68) to said first and second transducer (24) comprises first and second levers (54) that are operatively connected to respective ones of said transducers.

3. A controller (10) as claimed in claim 1 in which said operative connections of said mechanical input device (68) to said first and second transducers (24) comprise first and second levers (54) that are operatively connected to respective ones of said transducer; and said means for selectively changing said proportionality comprises means (72, 74, 82, or 84) for selectively changing the effective length of one of said levers.

4. A controller (10) as claimed in claim 1 in which said transducers (24) comprise rotary transducers each having first (26) and second (28) relatively rotatable portions;

said operative connections of said mechanical input device (68) to said transducers comprise said mechanical input device (68) being operatively connected to one of said relatively rotatable portions of each of said rotary transducers;

said operative connections further comprise first and second levers (54) that are operatively connected to the other of said relatively rotatable portions of respective ones of said rotary transducers; and said means for selectively changing said proportionality comprises means for pivoting one of said levers selectively at first (76) and second (78 or 80) distances form said other rotatable portion.

5. A controller (10) as claimed in claim 1 in which said transducer (24) comprise rotary transducers; and said means for producing one of said outputs comprises means for pivoting both of said transducers about a pivot axis (32).

6. A controller (10) as claimed in claim 1 in which said means for changing said proportionality comprises means (72, 74, 82, 84) for changing said proportionality with respect to selective positioning of said mechanical input device (68) along said one axis without affecting said proportionality with respect to selective positioning of said mechanical input device along the other of said axes.

7. A controller (10) as claimed in claim 1 in which said means for changing said proportionality comprises means (72, 74, 82, 84) for changing said proportionality comprises means (72, 74, 82, 84) for changing said proportionality of one of said transducers (24) without changing said proportionality of the other of said transducers.

8. A controller (10) as claimed in claim 1 in which said means for changing said proportionality comprises means (72, 74, 82, 84) for changing said proportionality of one of said transducers (24), and means (72, 74, 82, 84) for separately changing said proportionality of the other of said transducers.

9. A controller (10) as claimed in claim 1 in which said transducers (24) comprise rotary transducers each having first (26) and second (28) rotatable portions that are rotationally positionable around transducer axes (31); and said transducer axes are substantially coaxial.

10. A controller (10) as claimed in claim 1 in which said transducers (24) comprise rotary transducers each having a shaft (26) and a body (28) rotationally positionable around a transducer axis (31); and said transducer axes are disposed with said transducer axes substantially coaxial and with said bodies distal from one another.

11. A controller (10) as claimed in claim 1 in which said first transducer (24) comprises first (26) and (28) second portions that are relatively rotatable around a transducer axis (31);

said transducer axis of said first transducer is dispose parallel to one of said orthogonally-disposed axes;

said controller comprises means for pivoting both of said transducers (24) around one of said orthogonally-disposed axes in response to selective positioning of said input device (68) around said one orthogonally-disposed axis; and said producing of said outputs from said transducers comprises producing outputs from both of said transducers when said mechanical input device is rotationally positioned around either of said orthogonally-disposed axes.

12. A controller (10) as claimed in claim 1 in which said first transducer (24) comprises first (26) and second (28) portions that are relatively rotatable around a transducer axis (31);

said transducer axis of said first transducer is disposed parallel to one of said orthogonally-disposed axes; and said producing of said outputs from said transducers (24) comprises producing outputs from both of said transducers when said mechanical input device (68) is rotationally positioned around either of said orthogonally-disposed axes.

13. A controller (10) as claimed in claim 1 in which said controller comprises means for relative rotational positioning of both of said transducers (24) in the same direction proportional to selective positioning of said mechanical input device (68) around one of said orthogonally-disposed axes; and said controller comprises means for relative rotational positioning of said first and second transducers in opposite directions proportional to selective positioning of said mechanical input device around the other of said orthogonally-disposed axes.

14. A controller (10) which comprises:

a first part (12);

means, comprising a second part (20), for allowing said first part to pivot around orthogonally-intersecting first and second axes;

first and second transducers (24) each having first (26) and second (28) relatively rotatable portions;

means, comprising attaching one of said portions of said first and second transducers to said first part, for pivoting both of said transducers around one of said axes (X or Y) in accordance with selective positioning of said first part about said one axis; and means, comprising first and second mechanical connections (54, 58, 60, 62) between said second part and respective ones o the other of said portions of said transducers, for positioning said second portions of said transducers proportional to said selective positioning of said first part around said one axis.

15. A controller (10) as claimed in claim 14 in which said first part (12) includes a spherical contour (14) that is disposed around said first and second axes, and around a third axis that orthogonally intersects said first and second axes;

said means for allowing said first part to pivot around said first and second axes comprises said spherical contour and a cooperating surface (46) on said second part (20); and said controller includes means (36, 40) for preventing rotational movement of said first part about said third axis.

16. A controller (10) as claimed in claim 14 in which said controller includes means, comprising a first surface (16) of said first part (12), comprising said second part (20) having a second surface (46), and comprising means (48) for resiliently urging said second surface against said first surface, for urging said first part to pivot around said first and second axes toward a centered position.

17. A controller (10) as claimed in claim 14 in which said first and second mechanical connections comprise first and second levers (54) that are attached to respective ones of said first and second transducers (24).

18. A controller (10) as claimed in claim 14 in which said first and second mechanical connections comprise first and second levers (54) that are attached to respective ones of said first and second transducers (24), and that respectively include first and second slots (56); and said controller includes means (60), being operatively attached to said second part (20), for engaging said first and second slots.

19. A controller (10) as claimed in claim 14 in which one of said mechanical connections comprises a lever (54) that is attached to one of said transducers (24);

said controller includes means (60), being operatively attached to said second part (20), for operatively engaging said lever distal from said attachment thereof to said one transducer; and said controller includes means (72 or 74) for changing the effective distance (76, 78, or 80) between said one transducer and said operative engagement of said lever.

20. A controller (10) as claimed in claim 14 in which said second mechanical connection comprises a lever (54) that is attached to one of said transducers (24) and that includes a slot (56) distal from said second connection to said one transducer; p1 said controller includes means, comprising a pin (60) that is inserted into a pin hole (62) in said second part (20), for operatively engaging said slot at a first effective distance (76) from said one transducer; and said controller includes means, comprising a second pin hole (72 or 74) in said second part, for selectively changing said first effective distance to a second effective distance (78 or 80).

21. A controller (10) as claimed in claim 14 in which said controller includes means (72, 74, 82 or 84) for selectively changing said proportionality with respect to movement around one of said axes (X or Y).

22. A method for producing non-mechanical outputs that are proportional to X and Y mechanical inputs, which method comprises:

a) providing a mechanical input with respect to orthogonally-disposed axes (X and Y);

b) developing a first non-mechanical output that is proportional to said mechanical input with respect to one of said axes;

c) developing a second non-mechanical output that is proportional to said mechanical input with respect to the other of said axes; and d) selectively changing said proportionality with respect to one of said axes.

23. A method as claimed in claim 22 in which said providing step comprises mechanically engaging a first transducer at a first distance from said transducer; and said selective changing step comprises changing said first distance to a second distance.

24. A method as claimed in claim 22 in which one of said developing steps comprises rotationally positioning first and second transducers for positioning about said one of said axes in response to one of said mechanical inputs.

25. A method as claimed in claim 22 in which said selective changing step comprises selectively changing said proportionality with respect to said one axis without changing said proportionality with respect to the other of said axes.

26. A method as claimed in claim 22 in which said selective changing of said proportionality comprises selectively changing said proportionality with respect to one of said outputs without changing said proportionality with respect to the other of said outputs.

27. A method which comprises:

a) guiding a first part for positioning around the intersection of X and Y axes;

b) mounting first portions of first and second transducers onto said first part for pivoting said transducers about one of said axes; and c) providing mechanical inputs to second portions of both of said transducers proportional to one mechanical input with respect to the one of said axes.

28. A method as claimed in claim 27 in which said method further comprises changing said proportionality with respect to said one mechanical input without changing said proportionality with respect to the other of said mechanical inputs.

29. A controller (10) for providing outputs that are proportional to mechanical inputs with respect to orthogonally-disposed first and second (X and Y) axes, which controller comprises:

first and second transducers (24) each having first (26) and second (28) portions that are relatively rotationally positionable;

means (12), being operatively connected to one of said portions of both of said transducers, for rotationally positioning said one portion of both of said transducers proportional to a mechanical input along one of said axes (X or Y); and means (54, 58, 60, 62), being operatively connected to the other of said portions of both of said transducers, for rotationally positioning said other portion of both of said transducers proportional to a mechanical input along the other of said axes (Y or X).

30. A controller (10) as claimed in claim 29 in which said one portion (26) of said first and second transducers (24) comprises first and second shafts (26); and said other portion (28) of said first and second transducers comprises first and second bodies (28).

31. A controller (10) as claimed in claim 29 in which said controller comprises means (72, 74, 82, or 84) for changing said proportionality with respect to one of said mechanical inputs (X or Y).

32. A controller (10) as claimed in claim 29 in which said portions (26, 28) of said first transducer (24) are relatively rotatable about a transducer axis (31);

said transducer is parallel to one of said orthogonally-disposed axes (X or Y), and is orthogonal to the other of said orthogonally-disposed axes; and said controller produces an output from both of said transducers (24) when said mechanical input is along either of said axes.

33. A controller (10) as claimed in claim 29 in which said portions (26, 28) of said transducers (24) are relatively rotatable about first and second transducer axes (31); and said transducer axes are coaxial.

34. A controller (10) as claimed in claim 29 in which said portions (26, 28) of said first transducer (24) are relatively rotatable about a transducer axis (31);

said transducer is parallel to one of said orthogonally-disposed axes and is orthogonal to the other of said orthogonally-disposed axes;

an input along one of said axes results in relative rotation of said portions (26, 28) of said first transducer in the same direction as the relative rotation of said portions of said second transducer (24); and an input along the other of said axes results in relative rotation of said portions of said first transducer in the opposite direction from relative rotation of said portions of said second transducer.

35. A controller (10) as claimed in claim 29 in which said controller comprises means (12), comprising a mechanical input device (68), for positioning both of said transducers around one axis (X or Y) proportional to one of said mechanical inputs (X or Y).

36. A method for producing proportional outputs from first and second rotary transducers, that include first and second relatively rotational portions, in response to mechanical inputs around orthogonally-disposed (X and Y) axes, which method comprises:

a) rotationally positioning one portion of both of said transducers proportional to one of said mechanical inputs; and b) rotationally positioning the other portion of both of said transducers proportional to the other of said mechanical inputs.

37. A method as claimed in claim 36 in which said method further comprises changing said proportionality with respect to said one mechanical input.

38. A method as claimed in claim 36 in which said method comprises pivoting both of said transducers about one axis proportional to one of said mechanical inputs.

39. A method as claimed in claim 36 in which said method further comprises producing said outputs from both of said transducers in response to either of said inputs.

40. A method as claimed in claim 36 in which said method further comprises:

a) relatively rotationally positioning said first and second portions of said first transducer in one direction in response to one of said inputs;

b) relatively rotationally positioning said first and second portions of said second transducer in said one direction in response to said one of said inputs; and c) relatively rotationally positioning said portions of said first and second transducers in opposite directions in response to the other of said inputs.

41. A controller (10) which comprises: a mechanical input device (68);

first and second transducers (24) each having a body (28), and each having a rotary shaft (26) that is rotationally positionable about a transducer axis (31);

means, comprising means (14, 30) for mechanically coupling said shafts coaxially with said bodies distal from one another, and comprising means (14, 30, 54, 58, 60, 62) for mechanically connecting said mechanical input device to said transducers, for producing outputs from said transducers that are proportional to displacement of said mechanical input device around said transducer axis; and means for producing outputs from both of said transducers in response to movement of said mechanical input device about an axis (Y) that is orthogonal to said transducer axis.

42. A method for producing proportional outputs from first and second transducers, each having a body and each having a rotary shaft that is rotatable around a transducer axis, which method comprises:

a) rotationally securing said shafts, whereby said shafts rotate as a single shaft;

b) using a first mechanical input to rotate both of said shafts; and c) using a second mechanical input, that is disposed orthogonally to said first input, for producing outputs from both of said transducers.

43. A controller (10) which comprises:

means, comprising first and second transducers (24), and comprising a mechanical input device (68) that is operatively connected to said transducers, for producing outputs from said transducers that are proportional to displacement of said mechanical input device from the intersection of orthogonally-disposed (X and Y) axes;

means (84) for limiting movement of said mechanical input device to a substantially circular path (86) about said intersection of said axes; and means (72, 74, 82, or 84) for mechanically changing said proportionality with respect to one of said axes.

44. A method for producing outputs from first and second transducers proportional to displacement of a mechanical input device from the intersection of orthogonally-disposed axes, which method comprises:

a) limiting movement of said mechanical input device to a substantially circular path (86) about said intersection of said axes; and b) mechanically changing said proportionality with respect to one of said axes.

45. A controller (10) which comprises:

first and second transducers (24);

a mechanical input device (68) being operatively connected to both of said transducers;

means (12, 30, 54, 58, 60, 62), comprising said operative connection of said mechanical input device to said transducers, for producing outputs from said transducers that are proportional to displacement of said mechanical input device form the intersection of first and second axes; and means (72, 74, 82, or 84) for selectively changing said proportionality of one of said transducers from a first proportionality to a second proportionality with respect to movement of said mechanical input device along one of said axes without changing said proportionality of the other of said transducers.

46. A controller (10) as claimed in claim 45 in which said controller comprises means (72, 74, 82, or 84) for changing said proportionality of the other of said transducers (24) to a third proportionality with respect to movement of said mechanical input device (68) along said one axis without the necessity of changing said second proportionality of said one transducer (24).

47. A controller (10) as claimed in claim 46 in which said controller comprises means (14, 30) for producing an output from both of said transducers (24) that is a fourth proportionality with respect to movement of said mechanical input device (68) along the other of said axes.

48. A method which comprises:

a) producing outputs from first and second transducers that are proportional to displacement of a mechanical input device from the intersection of X and Y axes; and b) selectively changing said proportionality of one of said transducers from a first proportionality to a second proportionality with respect to movement of said mechanical input device along said one axis without changing said proportionality of the other of said transducers.

49. A method as claimed in claim 48 in which said method further comprises:

a) changing said proportionality of the other of said transducers to a third proportionality with respect to movement of said mechanical input device along said one axis; and b) optionally maintaining said second proportionality of said one transducer.

50. A method as claimed in claim 49 in which said method further comprises producing an output from both of said transducers that is to a fourth proportionality with respect to movement of said mechanical input device along the other of said axes.

51. A method which comprises:

a) producing outputs from first and second transducers that are proportional to movement of a mechanical input device from the intersection of X and Y axes; and b) producing outputs from said transducers that are to a different proportionality with respect to movement of said mechanical input device along one of said axes.

52. A controller (10) which comprises:

a mechanical input device (68);

guiding means (20), being operatively attached to said mechanical input device, for allowing selective positioning of said mechanical input device with respect to orthogonally-disposed first and second (X and Y) axes;

first and second transducers (24) each having first (26) and second (28) portions that are relatively rotational around respective ones of transducer axes (31);

means, comprising disposing said transducer axes coaxially, rotationally securing one of said portions of one of said transducers to one of said portions of the other of said transducers, and operatively connecting both of said transducers to said mechanical input device, for producing outputs from both of said transducers that are proportional to selective positioning of said mechanical input device along one (X or Y) of said axes; and means, comprising means for operatively connecting (54, 58, 60, 62) said transducers to said guiding means, for producing outputs from both of said transducers that are proportional to selective positioning of said mechanical input device along the other (Y or X) of said axes.

53. A controller (10) as claimed in claim 52 in which said controller comprises means for changing said proportionality with respect to selective positioning of said mechanical input device (68) along one of said axes.

54. A controller (10) as claimed in claim 52 in which said controller comprises means for changing said proportionality of one of said transducers (24) with respect to selective positioning of said mechanical input device (68) along one of said axes without changing said proportionality of the other of said transducers.

55. A controller (10) as claimed in claim 52 in which said controller comprises means for pivoting both of said transducers (24) around said axis in response to selective positioning of said mechanical input device (68) along said one axis.

56. A controller (10) as claimed in claim 52 in which one of said transducer axes (31) is disposed parallel to one of said orthogonally-disposed axes and orthogonal to the other of said orthogonally-disposed axes;

said controller comprises means for producing outputs from both of said transducers (24) when said mechanical input device (68) is selectively positioned along one of said axes; and said controller comprises means for producing outputs form both of said transducers when said mechanical input device is selectively positioned along the other of said axes.

57. A controller (10) as claimed in claim 52 in which said controller comprises means for relatively rotating said portions (26, 28) of said first transducer (24) in one direction in response to said mechanical input device (68) being selectively positioned along one of said axes;

said controller comprises means for relatively rotating said portions of said second transducer (24) in said one direction in response to said mechanical input device being selectively positioned along said one axis; and said controller comprises means for relatively rotating said portions of said first and second transducers in opposite directions in response to said mechanical input device being selectively positioned along the other of said axes.

58. A method for producing X and Y proportional outputs from first and second rotary transducers, having first and second portions that are rotatable around respective transducer axes, in response to orthogonally-disposed X and Y mechanical inputs, which method comprises:

a) disposing said transducer axes coaxially; and b) rotationally securing one of said portions of one of said transducers to one of said portions of the other of said transducers.

59. A method as claimed in claim 58 in which said method further comprises changing said proportionality with respect to one of said mechanical inputs.

60. A method as claimed in claim 58 in which said method further comprises pivoting both of said transducers about one of said axes in response to one of said inputs.

61. A method as claimed in claim 58 in which said method further comprises producing said outputs from both of said transducers in response to either of said inputs.

62. A method as claimed in claim 58 in which said method further comprises:

a) relatively rotationally positioning said first and second portions of aid first transducer in one direction in response to one of said inputs;

b) relatively rotationally positioning said first and second portions of said second transducer in said one direction in response to said one of said inputs; and c) relatively rotationally positioning said portions of said first and second transducers in opposite directions in response to the other of said inputs.

* * * * *

UNITED STATES PATENT AND TRADEMARK OFFICE

CERTIFICATE OF CORRECTION

PATENT NO. : 5,129,277

DATED : 14 July 1992

INVENTOR(S) : John L. Lautzenhiser

It is certified that error appears in the above-identified patent and that said Letters Patent is hereby corrected as shown below:

In column 5, --increasing the angle of rotation of the transducer bodies,-- should be inserted between "thereby" and "thereby" in line 38; and --increasing the angle of rotation of the transducer bodies,-- should be inserted before "thereby" in line 42. In column 7, --include first and second relatively rotational portions, in response to mechanical inputs around orthogonally-disposed (X and Y)-- should be inserted between "that" and "axes" in line 5. In Claim 7, "comprises means (72, 74, 82, 84) for changing said proportionality" should be deleted in lines 51 and 52. (Column 15)

Signed and Sealed this

Twenty-sixth Day of October, 1993

*Attest:*

Bruce Lehman

BRUCE LEHMAN

*Attesting Officer*

*Commissioner of Patents and Trademarks*